US008824954B2

(12) United States Patent
Nishimura

(10) Patent No.: US 8,824,954 B2
(45) Date of Patent: Sep. 2, 2014

(54) IMAGE FORMING APPARATUS

(75) Inventor: Yutaka Nishimura, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 45 days.

(21) Appl. No.: 13/602,843

(22) Filed: Sep. 4, 2012

(65) Prior Publication Data

US 2013/0142556 A1 Jun. 6, 2013

(30) Foreign Application Priority Data

Dec. 5, 2011 (JP) ..... 2011-265734

(51) Int. Cl.
*G03G 15/00* (2006.01)

(52) U.S. Cl.
USPC ..... 399/406; 399/397

(58) Field of Classification Search
USPC ..... 399/406
See application file for complete search history.

(56) References Cited

U.S. PATENT DOCUMENTS 5,824,408 A 10/1998 Kume et al.
5,848,347 A * 12/1998 Kuo et al. ..... 399/406
5,920,751 A * 7/1999 Chow et al. ..... 399/97
6,023,597 A 2/2000 Mayuzumi et al.
6,259,888 B1 * 7/2001 Kazama et al. ..... 399/406
7,654,519 B2 2/2010 Yamane et al.
8,265,541 B2 * 9/2012 Kougami ..... 399/406
2005/0063747 A1 * 3/2005 Ushio ..... 399/406
2007/0132174 A1 6/2007 Yamane et al.
2008/0050164 A1 * 2/2008 Yanagi et al. ..... 400/582
2009/0003912 A1 * 1/2009 Nagasaki et al. ..... 399/406
2010/0135708 A1 * 6/2010 Goto ..... 399/406
2011/0097127 A1 * 4/2011 Yoshida et al. ..... 399/406
2011/0236102 A1 * 9/2011 Furushige et al. ..... 399/406

FOREIGN PATENT DOCUMENTS

JP 2007-161398 A 6/2007

* cited by examiner

*Primary Examiner* — Anthony Nguyen
(74) *Attorney, Agent, or Firm* — Fitzpatrick, Cella, Harper & Scinto

(57) ABSTRACT

An image forming apparatus starts to change a curl correcting amount until when an upstream end in a sheet conveying direction of a preceding sheet passes through a curl correcting unit and finishes changing the curl correcting amount until when a succeeding sheet that follows the preceding sheet reaches the curl correcting unit in a case when the preceding sheet and the succeeding sheet are both guided in the curl correcting unit through a conveying path and when the curl correcting amount is changed between curl correcting amounts of the preceding sheet and the succeeding sheet.

11 Claims, 7 Drawing Sheets

IMAGE FORMING APPARATUS

BACKGROUND OF THE INVENTION

1. Field of the Invention

This invention relates to an image forming apparatus and more specifically to the image forming apparatus including a curl correcting unit configured to correct a curl caused in a sheet.

2. Description of the Related Art

Hitherto, an image forming apparatus such as a copier and a printer is configured to transfer a toner image formed in an image forming unit thereof on a sheet fed from a sheet feeding portion and then to guide the sheet to a fixing unit to fix the toner image on the sheet. Among such fixing units, there is a thermal pressure fixing-type fixing unit configured to fix the toner image on the sheet by pressurizing and heating the sheet passing through the fixing unit. Still further, among the conventional image forming apparatuses, there is one that is provided with a sheet processing unit to be able to readily carry out such processes as sorting, stapling, punching and book-binding of the sheets.

By the way, the sheet on which the toner image has been fixed in the fixing unit is liable to cause a curl by absorbing moisture condensed on a guide of the fixing unit and vapor in a surrounding area. If the sheet thus curls, there is a possibility of not only causing jamming of the sheet but also of dropping performance in stacking the sheet on a tray after its discharge. Then, in order to correct such a curl of the sheet, there is one provided with a curl correcting unit between the image forming apparatus and the sheet processing unit.

Among such curl correcting units, there is a roller nip-type curl correcting unit composed of an elastic roller and a pressure roller that rotates while forming a curved nip portion by pressurizing the elastic roller. The curl correcting unit is configured to correct (to straighten) the sheet so as to have no curl by temporarily curving and deforming the sheet in a direction opposite from a direction in which the sheet is curled.

It is noted that condition of the curl of the sheet differs depending on density of the image formed on the sheet and on a difference of environmental humidity. Therefore, the curl correcting unit is configured to able to adequately correct the curl by adjusting a force of the pressure roller, i.e., an amount of bite of the pressure roller to the elastic roller, corresponding to such detected information.

Still further, among the late image forming apparatuses, there is one that is configured to increase sheet conveying speed in passing the sheet through the curl correcting unit to improve productivity of the apparatus. However, if the sheet conveying speed increases as described above, there is a possibility that the curl is not fully corrected because a time during which the sheet passes through the curl correcting unit is shortened in this case. Then, in order to prevent the curl from being defectively corrected in the image forming apparatus as described above, Japanese Patent Application Laid-open No. 2007-161398 discloses an arrangement of increasing the pressurizing force in connection with the increase of the sheet conveying speed.

In order to accommodate to a variety of needs of users, some image forming apparatuses include a consolidated mode of forming images on different types of sheets and of conveying the sheets to the sheet processing unit in one JOB. However, because a degree of curl of the sheet is different depending on the types of sheets, it is necessary to switch the amount of bite of the pressure roller to the elastic roller in such consolidated mode corresponding to the respective types of sheets.

However, with the increase of the sheet conveying speed, an interval or a distance between a rear edge of a preceding sheet and a front edge of a succeeding sheet tends to be narrowed in the late image forming apparatuses, so that it is difficult to complete the operation for switching the amount of bite temporally during the interval between the sheets described above. Then, there is a possibility that the correction of curl cannot be fully made on the different types of sheets when it is unable to complete the operation of switching the amount of bite during the temporal interval between the sheets.

SUMMARY OF THE INVENTION

The present invention provides an image forming apparatus configured to be able to securely correct a curl of a sheet. According to an aspect of the present invention, an image forming apparatus configured to form an image on a sheet includes an image forming unit configured to form a toner image on the sheet, a fixing unit configured to fix the toner image on the sheet, a curl correcting unit configured to correct a curl of the sheet that has passed through the fixing unit and to vary a curl correcting amount for correcting the curl of the sheet, a conveying path configured to guide the sheet from the fixing unit to the curl correcting unit while keeping a downstream end in a sheet conveying direction of the sheet at the fixing unit as the downstream end in the sheet conveying direction at the curl correcting unit, and a control unit configured to control the curl correcting unit to start changing the curl correcting amount until when an upstream end in the sheet conveying direction of a preceding sheet passes through the curl correcting unit and to finish changing the curl correcting amount until when a succeeding sheet that follows the preceding sheet reaches the curl correcting unit in a case when the preceding sheet and the succeeding sheet are both guided in the curl correcting unit through the conveying path and when the curl correcting amount is changed between curl correcting amounts of the preceding sheet and the succeeding sheet.

Further features of the present invention will become apparent from the following description of exemplary embodiments with reference to the attached drawings. The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENT

A mode for carrying out the invention will be explained in detail below with reference to the drawings.

Figure 1:
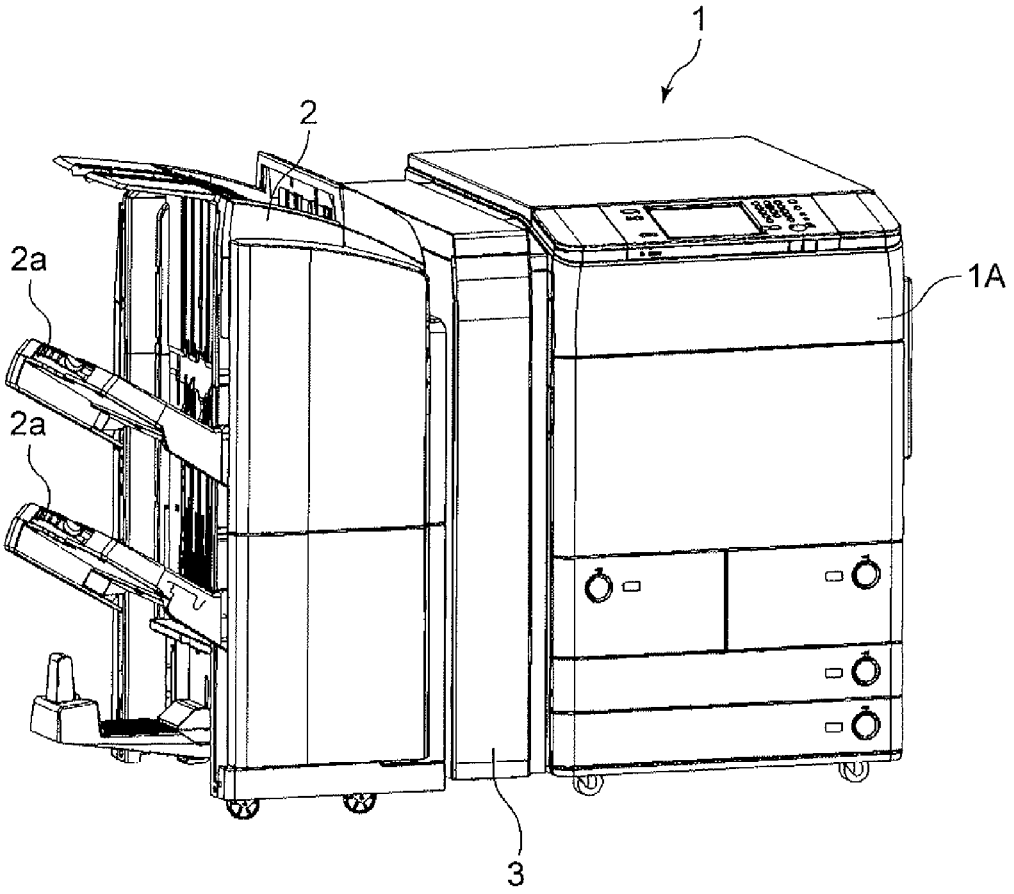
FIG. 1 is a perspective view of a color laser printer, i.e., an exemplary image forming apparatus, of an embodiment of the invention.
Figure 2:
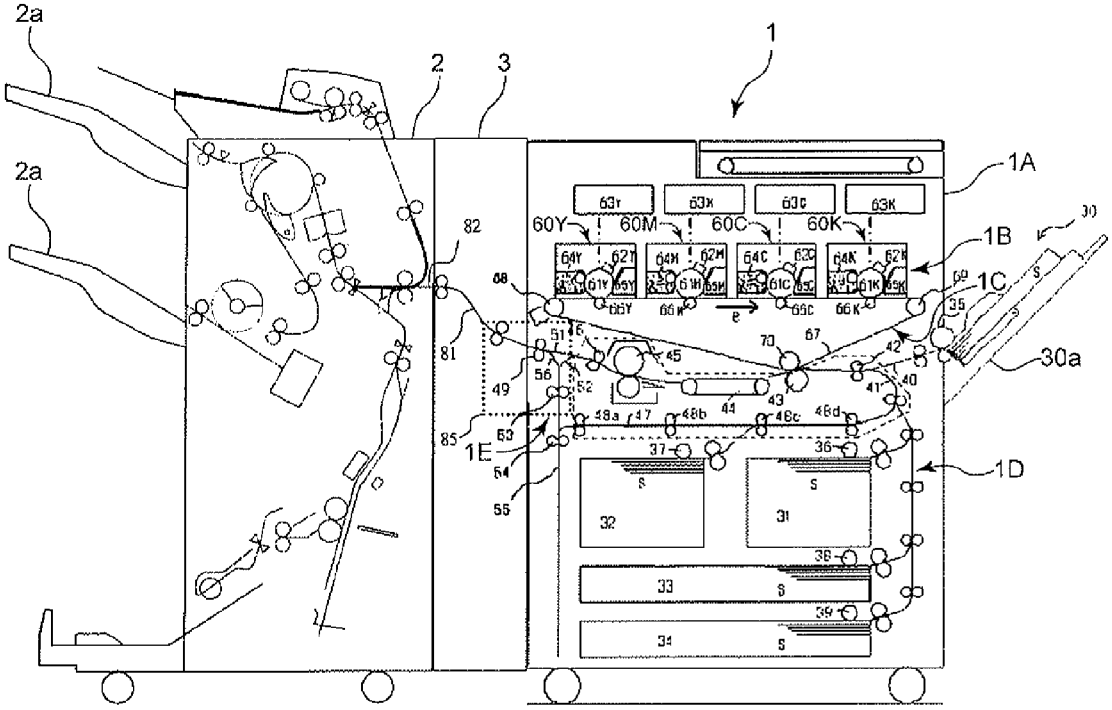
FIG. 2 illustrates a schematic configuration of the color laser printer.

FIG. 1 is a perspective view of a color laser printer, i.e., an exemplary image forming apparatus, of an embodiment of the invention, and FIG. 2 illustrates a schematic configuration thereof. FIGS. 1 and 2 show the color laser printer 1 that includes a printer body 1A, i.e., a body of the image forming apparatus, and a sheet processing unit 2 connected at one side of the printer body 1A and configured to perform such processes as folding, stapling, punching and book-binding processes. Still further, a buffer unit 3 having a curl correcting unit described later is provided between the printer body 1A and the sheet processing unit 2.

Here, the printer body 1A is provided with an image forming unit 1B, an intermediate transfer portion 1C, a fixing unit 45, a sheet feeding unit 1D for feeding a sheet S to the image forming unit 1B, and a manual sheet feeding unit 30 for feeding a sheet manually supplied. It is noted that the color laser printer 1 is configured to be able to form an image on a back of a sheet and is provided with a re-conveying portion 1E so that a sheet S on which an image has been formed on a surface (first surface) thereof is reversed and is conveyed again to the image forming unit 1B.

Here, the image forming unit 1B is provided with four processing stations 60, i.e., 60Y, 60M, 60C and 60K, that form four color toner images of yellow (Y), magenta (M), cyan (C), and black (Bk), respectively. These processing stations are provided with photosensitive drums 61, i.e., image carriers 61Y, 61M, 61C and 61K, that carry the four color toner images of yellow, magenta, cyan, and black and driven by stepping motor not shown, and with chargers 62, i.e., 62Y, 62M, 62C and 62K, configured to uniformly charge surfaces of the photosensitive drums, respectively.

The processing stations are also provided with scanners 63, i.e., 63Y, 63M, 63C and 63K, that irradiate laser beams respectively to the photosensitive drums that rotate with constant speed based on image data to form electrostatic latent images thereon. The processing stations are also provided with developers 64, i.e., 64Y, 64M, 64C and 64K that apply toners of yellow, magenta, cyan, and black to the electrostatic latent images formed on the photosensitive drums to visualize as toner images. The chargers 62, the scanners 63, the developers 64 and others are disposed around the photosensitive drums 61 respectively along a rotating direction of the respective drums.

The sheet feeding unit 1D is provided at an under part of the printer body and is provided with sheet feeding cassettes 31 through 34, i.e., sheet storage portions for storing the sheets S, and pickup rollers 36 through 39 that send out the sheets S stacked and stored in the sheet feeding cassettes 31 through 34. The manual sheet feeding unit 30 includes a manual feed tray 30*a*, i.e., a sheet storing portion for stacking and storing the sheets S, and a sheet feeding roller 35 being configured to feed the sheet S stacked on the manual feed tray 30*a*.

When an image forming operation starts, the sheet S is separated and fed one by one by the pickup rollers 36 through 39 from the sheet feeding cassettes 31 through 34, passes through a vertical conveying path 41 and is conveyed to a registration roller 42. In a case of the manual feed, the sheet S stacked in the manual feed tray 30*a* is conveyed to the registration roller 42 by the feed roller 35 by passing through a conveying path 40. Here, the registration roller 42 has a function of adjusting the front edge of the sheet S to correct oblique motion thereof by butting the sheet S and creating a loop thereof. The registration roller 42 also has a function of conveying the sheet S to a secondary transfer portion by predetermined timing conforming to timing for forming an image on the sheet S, i.e., in conformity with the toner image carried on an intermediate transfer belt described below.

The intermediate transfer portion 1C has the intermediate transfer belt 67 that is rotationally driven in a direction in which the respective processing stations are arrayed as shown by an arrow B in FIG. 2 in synchronism with outer circumferential speed of the photosensitive drum 61. Here, the intermediate transfer belt 67 is stretched around a driving roller 69, a driven roller 70 that forms a secondary transfer area by interposing the intermediate transfer belt 67, and a tension roller 68 that applies adequate tension to the intermediate transfer belt 67 by urging force of a spring not shown.

Four primary transfer rollers 66, i.e., 66Y, 66M, 66C and 66K that nip the intermediate transfer belt 67 together with the respective photosensitive drums 61 and compose primary transfer portions are arrayed on the inside of the intermediate transfer belt 67. It is noted that these primary transfer rollers 66 are connected with a transfer biasing power source not shown. The respective color images on the photosensitive drums are superimposed and transferred sequentially on the intermediate transfer belt 67 and a full-color image is formed on the intermediate transfer belt 67 by transfer bias applied from the primary transfer rollers 66 to the intermediate transfer belt 67.

Still further, a secondary transfer roller 43 is disposed so as to face to the driven roller 70. This secondary transfer roller 43 contacts a surface of the intermediate transfer belt 67 at a lowest part thereof and nips and conveys the sheet S conveyed by the registration roller 42 together with the intermediate transfer belt 67. Then, the toner image on the intermediate transfer belt 67 is secondarily transferred to the sheet S by the bias voltage applied to the secondary transfer roller 43 when the sheet S passes through a nip portion between the secondary transfer roller 43 and the intermediate transfer belt 67. The fixing unit 45 is configured to fix the toner image formed on the sheet S through the intermediate transfer belt 67 on the sheet S. That is, the toner image is fixed on the sheet S by being applied with heat and pressure when the sheet S carrying the toner image passes through the fixing unit 45.

Next, an image forming operation of the color laser printer 1 constructed as described above will be explained. When the image forming operation starts, the scanner 63Y irradiates laser to the photosensitive drum 61Y to form a yellow latent image on the photosensitive drum 61Y in the processing station 60Y located at a most upstream side in the rotational direction of the intermediate transfer belt 67 at first. After that, the developer 64Y develops this latent image by yellow toner to form the yellow toner image.

Next, the yellow toner image formed on the photosensitive drum 61Y as described above is transferred primarily to the intermediate transfer belt 67 in the primary transfer area by the transfer roller 66 to which high voltage is applied. Then, the toner image is conveyed together with the intermediate transfer belt 67 to a next primary transfer area composed of the photosensitive drum 61M and the transfer roller 66M of the processing station 60M in which the image is formed behind the processing station 60Y by a time during which the magenta toner image is conveyed.

Then the next magenta toner image is transferred on the yellow toner image on the intermediate transfer belt 67 by aligning the front edge of the images. The same processes are repeated after that and as a result, the four color toner images are transferred primarily on the intermediate transfer belt 67 and the full-color image is formed on the intermediate transfer belt 67. It is noted that photosensitive drum cleaners 65, i.e., 65Y, 65M, 65C and 65K recover remaining transfer toner slightly left on the photosensitive drums to be ready to form a next image.

In parallel with the toner image forming operation, the sheet S stored in the feeding cassettes 31 through 34 for example is separated and fed one by one by the pickup rollers 36 through 39 and is then conveyed to the registration roller 42. In a case of manual feed, the sheet S stacked on the manual feed tray 30*a* is conveyed to the registration roller 42 by the sheet feeding roller 35 by passing through the conveying path 40. The registration roller 42 is stopped at this time, so that the oblique motion of the sheet S is corrected by butting against the registration roller 42 in the stopped state. After when the oblique motion is corrected, the sheet S is conveyed to the nip portion between the secondary transfer roller 43 and the intermediate transfer belt 67 by the registration roller 42 that starts its rotation with timing when the front edge of the sheet coincides with the toner image formed on the intermediate transfer belt 67.

Then, when the sheet S nipped and conveyed by the secondary transfer roller 43 and the intermediate transfer belt 67 passes through the nip portion between the secondary transfer roller 43 and the intermediate transfer belt 67, the toner image on the intermediate transfer belt 67 is transferred secondarily on the sheet S by the bias voltage applied to the secondary transfer roller 43. The sheet S on which the toner image has been secondarily transferred is then conveyed to the fixing unit 45 by a pre-fixing conveying unit 44.

The fixing unit 45 is configured to melt and fix the toner image on the sheet S by applying a predetermined pressurizing force by rollers, belts or the like opposing with each other and a heating effect by a heat source such as a heater in general. When the sheet S having the fixed image thus obtained is to be discharged here to the sheet processing unit 2 as it is, the sheet S is sent to a discharge conveying path 51, i.e., a conveying path, by an inner discharge roller 46 and is discharged out by an outer discharge roller 49.

When images are to be formed on both sides of the sheet S, the sheet S is sent to a reverse guide path 52 by a path switching portion not shown. After that, the sheet S is pulled into a switchback path 55 from the reverse guide path 52 by a reversing upper and lower rollers 53 and 54 to switch the front and rear edges of the sheet S by performing a switch-back operation of reversing a rotational direction of the reversing lower roller 54, and to convey to a duplex conveying path 47.

Next, the sheet S confluents again by adjusting timing with a succeeding sheet S conveyed by the pickup rollers 36 through 39 or the feed roller 35 by conveyor rollers 48*a* through 48*d* provided along the duplex conveying path 47. After that, the sheet S is sent to the secondary transfer portion through the registration roller 42. It is noted that the image forming process implemented on the back (second surface) after that is the same with that of the surface (first surface) as already described above.

Still further, when the sheet S is to be reversely discharged, the sheet S is pulled into the switchback path 55 from the reverse guide path 52 by the reversing upper and lower rollers 53 and 54. Then the reversing upper and lower rollers 53 and 54 are rotated reversely to convey the sheet S to a reverse conveying path 56, i.e., a reverse conveying path, in a direction opposite from the direction in which the sheet S has been pulled in by reversing the rear edge as the front edge. Then, the sheet S is reversely discharged out to the sheet processing unit 2 by the outer discharge roller 49 so that a downstream end and an upstream end in a sheet conveying direction of the sheet S is reversed.

It is noted that the sheet S guided by the discharge conveying path 51 or the reverse conveying path 56 and is discharged out of the printer body 1A by the outer discharge roller 49 is conveyed to a buffer path 81 provided in the buffer unit 3. Then, the sheet S is conveyed to a finisher conveying path 82 provided in the sheet processing unit 2 and is discharged to a discharge tray 2*a* after being processed in the sheet processing unit 2.

By the way, as described above, the sheet heated and fixed by the fixing unit 45 is liable to cause a curl by absorbing moisture condensed on the guide and surrounding vapor. Then, when the sheet curls, there is a possibility of causing not only jamming but also drop of performance in stacking the sheet on the discharge tray after the discharge. Then, a curl correcting unit configured to correct a curl of the sheet S is provided along the buffer path 81 of the buffer unit 3 in the present embodiment.

Figure 3:
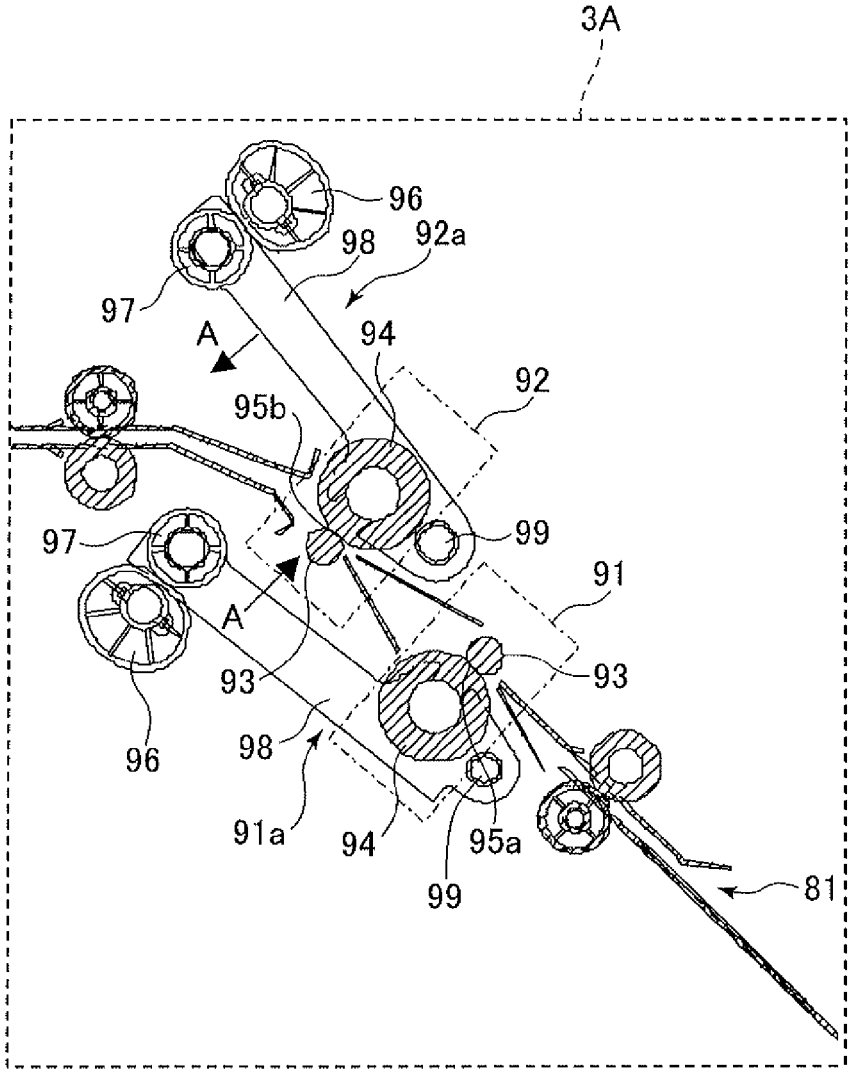
FIG. 3 illustrates a configuration of a curl correcting unit provided in a buffer unit of the color laser printer.

FIG. 3 illustrates a configuration of such curl correcting unit 3A. Here, the curl correcting unit 3A includes a first curl correcting portion 91 that corrects a curl in a first direction of the sheet, e.g., a downward curl that bulges a center part of the sheet upward. The curl correcting unit 3A also includes a second curl correcting portion 92 provided downstream in the sheet conveying direction of the first curl correcting portion 91 to correct a curl in a second direction of the sheet, e.g., an upward curl by which front and rear edge portions of the sheet bulge upward.

Here, the first curl correcting portion 91 is provided with a pair of curl correcting rollers of an elastic roller 94*a* and a stationary roller (metallic roller) 93*a* whose hardness is high and which press-contacts the elastic roller 94*a* from above (first direction). Here, the stationary roller 93*a* bites into the elastic roller 94*a* from above and form a nip portion 95*a* curved downward by press-contacting the pair of rollers 93*a* and 94*a* whose hardness is different. The second curl correcting portion 92 is also provided with a pair of curl correcting rollers of an elastic roller 94*b* and a stationary roller 93*b* which bites into the elastic roller 94*b* from below (second direction) to form a nip portion 95*b* curved upward in an opposite direction from that of the nip portion 95*a* of the first curl correcting portion 91.

When the sheet S passes through the curl correcting unit 3A provided with the first and second curl correcting portions 91 and 92 having the nip portions 95*a* and 95*b* whose curved portions are different as described above, the sheet S is curved and deformed temporarily downward in a vertical direction with respect to a conveying surface by the first curl correcting portion 91 at first. Thereby, the downward curl of the sheet S is corrected (straightened). Then, when the sheet S passes through the second curl correcting portion 92, the sheet S is curved and deformed temporarily upward in the vertical direction. Thereby, the upward curl is corrected (straightened).

The curl correcting unit 3A is provided with bite modifying portions 91*a* and 92*a* configured to modify an amount of bite of the stationary roller 93 into the elastic roller 94, i.e., curved amount modifying portions configured to modify an amount of curve of the nip portion, by changing position of the elastic roller 94 corresponding to the type of the sheet S. Here, the bite modifying portion 91*a* of the first curl correction portion 91 includes a cam 96*a* that is rotated by a bite control motor M1 shown in FIG. 4 and described later, and a link 98*a* provided with a roller 97*a* that abuts the cam 96 at first end thereof and rotatably supports the elastic roller 94. It is noted that the bite modifying portion 92*a* of the second curl correcting portion 92 is constructed in the same manner with the bite modifying portion 91*a* of the first curl correcting portion 91.

Then, when the bite control motor M1 is rotated to rotate the cam 96 by an angle set in advance, the roller 97 and the link 98 that supports the roller 97 turns in accordance to a profile of the cam 96 centering on a fulcrum 99 in a direction of an arrow A. Thereby, the elastic roller 94 supported by the link 98 moves in a direction of a center of the stationary roller 93, so that the amount of bite of the stationary roller 93 into the elastic roller 94 increases. Thus, level of the curve of the nip portion 95 composed of the stationary roller 93 and the elastic roller 94, i.e., the amounts of bite of the stationary roller 93 into the elastic roller 94, is changed depending on the type of the sheet S to perform the curl correction suitable to the type of the sheet S.

Figure 4:
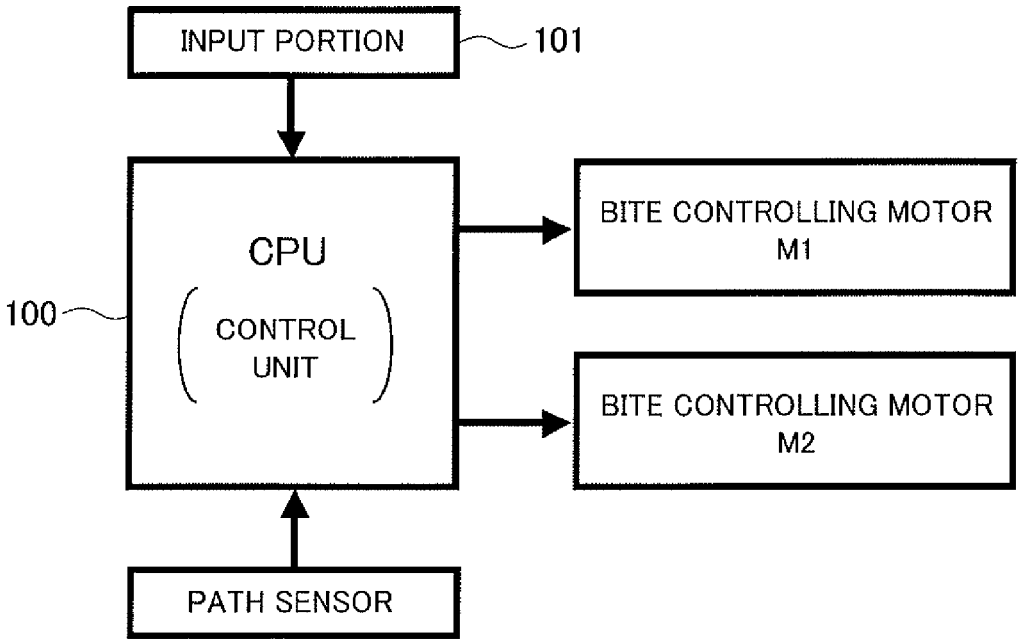
FIG. 4 is a control block diagram of the curl correcting unit.

FIG. 4 is a control block diagram of the curl correcting unit 3A configured to vary the curl correcting amount. FIG. 4 shows a CPU (control unit) 100 and an input portion 101, such as a manipulating portion provided on the printer body 1A, for inputting information such as sheet information concerning the type of the sheet S and mode information such as a discharge mode described later, the consolidated mode, a front edge pressing mode and a rear edge pressing mode to the CPU 100. Corresponding to the information on the respective modes and the information concerning the type of the sheet S input through the input portion 101, the CPU 100 drives the bite control motors M1 and M2 to set the curl correcting amount set in advance corresponding to the types of the sheets. It is noted the input portion 101 may be configured to input the curl correcting amount corresponding to the type of the sheet. Still further, the input portion 101 may be provided with a detector (sensor) not shown for detecting the type of the sheet along the conveying path, other than the manipulating portion, so that the CPU 100 can detect the type of the sheet based on a signal from the detector.

FIG. 4 also shows a path sensor SN disposed upstream of the sheet conveying direction of the curl correcting unit 3A to detect passage of the front edge of the sheet. The CPU 100 drives the bite control motors M1 and M2 based on a signal from the path sensor SN. It is noted that the CPU 100 may be provided either in the printer body 1A or in the buffer unit 3.

By the way, the laser printer 1 of the present embodiment is provided with the consolidated mode of forming images sequentially on different types of sheets and of conveying the sheets to the sheet processing unit 2 in one Job. In the case of the consolidated mode, the amount of bite is switched corresponding to the types of the sheets. Then, control for switching the amounts of bite in the consolidated mode will be explained below with reference to FIG. 5.

Figure 5:
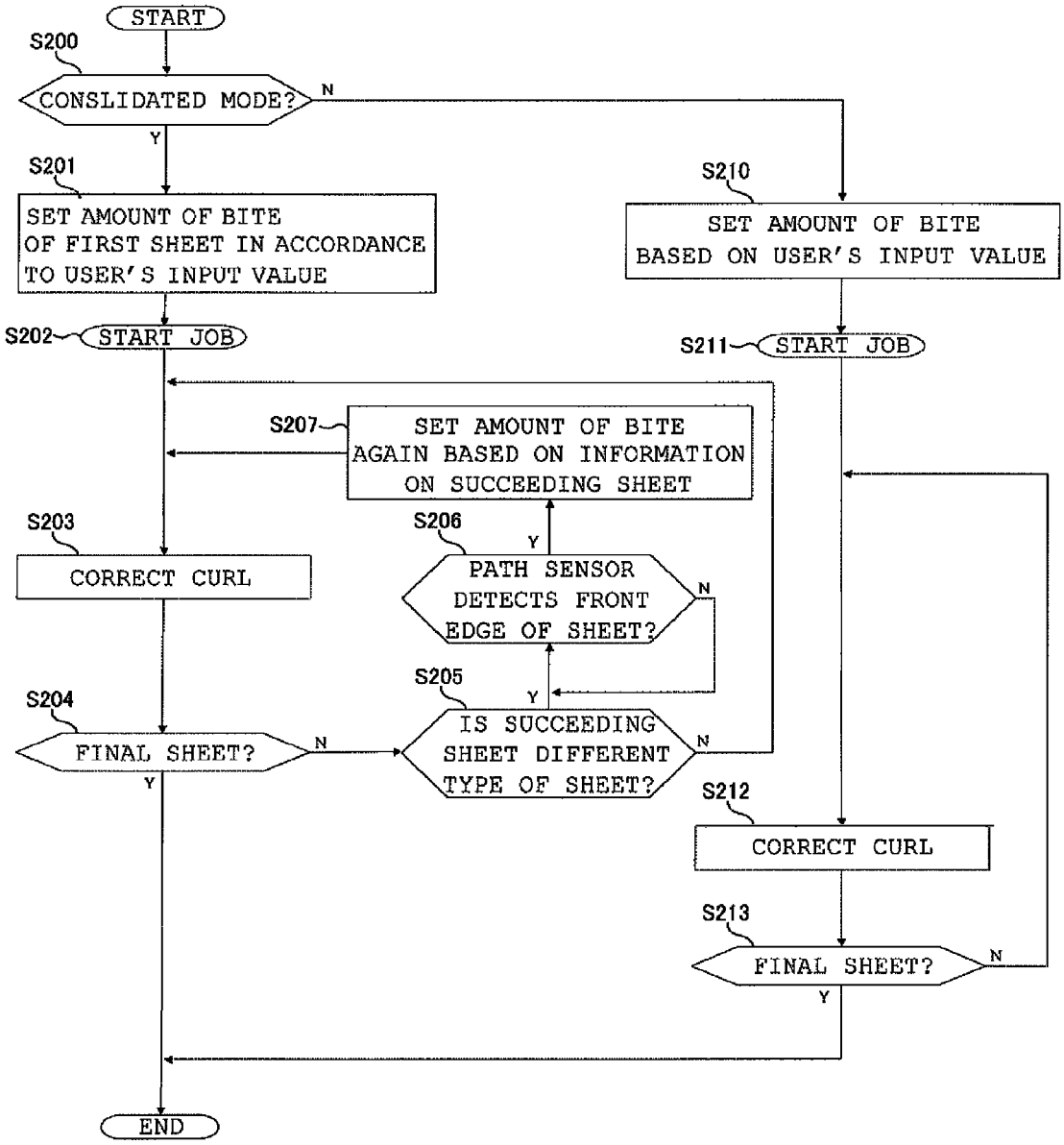
FIG. 5 is a flowchart of a bite switching control in a consolidated mode of the curl correcting unit.

As shown in FIG. 5, the CPU 100 judges whether or not mode information inputted through the input portion 101 is the consolidated mode in Step S200. Then, when the mode information is the consolidated mode, i.e., Yes in Step S200, the CPU 100 sets amounts of bite of a first sheet in the first and second curl correcting portions 91 and 92 in accordance to user's input value input through the input portion 101 by the user in Step S201 and starts the JOB in Step S202.

Next, the sheet is conveyed to the first and second curl correcting portions 91 and 92 for which the amounts of bite are set as described above to correct the curl of the sheet in Step S203. After that, the CPU 100 judges whether or not the sheet is a final sheet in Step S204 and when the sheet is not a final sheet, i.e., No in Step S204, the CPU 100 judges whether nor not the succeeding sheet is a different type of sheet in Step S205. When the CPU 100 judges that the succeeding sheet is a different type of sheet here, i.e., Yes in Step S205, the CPU 100 waits for time when the path sensor detects a front edge of the succeeding sheet in Step S206.

When the path sensor detects the front edge of the succeeding sheet, i.e., Yes in Step S206, the CPU 100 sets amounts of bite again based on information concerning the type of the succeeding sheet in Step S207. Then, the sheet is conveyed to the first and second curl correcting portions 91 and 92 for which the amounts of bite are set again as described above to correct a curl of the different type of the sheet in Step S203. After that, by detecting the final sheet, i.e., Yes in Step S204, the CPU 100 ends the JOB.

When the CPU 100 judges that the succeeding sheet is the same type of sheet, i.e., No in Step S205, the CPU 100 conveys the sheet to the first and second curl correcting portions 91 and 92 for which the same amounts of bite are set to correct the curl of the sheet in Step S203. Still further, when the mode information is not the consolidated mode, i.e., Yes in Step S200, the CPU 100 sets amounts of bite of the first and second curl correcting portions 91 and 92 in accordance to the user's input values input through the input portion 101 by the user in Step S210 and then starts the JOB in Step S211.

Then, the sheet is conveyed to the first and second curl correcting portions 91 and 92 for which the amounts of bite are set as described above to correct the curl of the sheet in Step S212. After that, the CPU 100 judges whether or not the sheet is a final sheet in Step S213 and when the sheet is not a final sheet, i.e., No in Step S213, the curls of the sheets are corrected continuously in Step S212. Then, detecting the final sheet, i.e., Yes in Step S213, the CPU 100 ends the JOB.

By the way, while there is a case of switching the amounts of bite per every sheet in such consolidated mode, it is difficult to complete the bite switching operation only in the sheet temporal interval because the sheet interval is set to be very small to realize high productivity in this case. The curl of a sheet is caused mostly by the moisture condensed on the guide and the surrounding vapor absorbed by the sheet after fixation by heat as described above. That is, a front edge portion of the sheet is inclined to curl largely after the fixation.

Figure 6A:
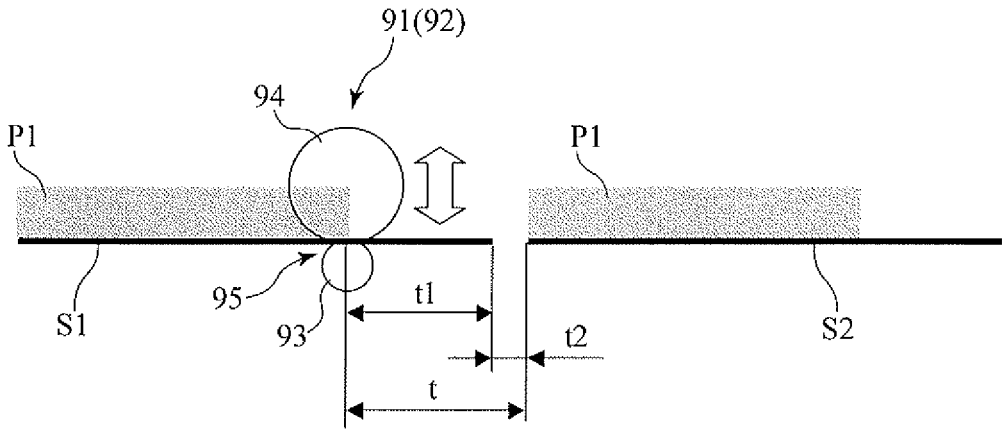
FIG. 6A is a diagram explaining a curl correcting operation in a front edge pressurizing mode of the curl correcting portion provided in the curl correcting unit.

Then, as shown in FIG. 6A, the CPU 100 of the present embodiment is arranged to start the bite switching operation, i.e., the operation of moving the elastic roller 94 in a direction of an arrow shown in FIG. 6A, until the rear edge of the preceding sheet S1 passes through the nip portion 95. Thereby, the operation of moving the elastic roller 94 in the direction of the arrow is started after pressing a pressure range P of the sheet including the front edge portion of the preceding sheet S1 with a predetermined amount of bite.

With this arrangement, a switching time t for performing the bite switching operation can be a total time of a time t1 from when the rear end of the pressure range P including the front edge of the preceding sheet passes through the nip portion 95 until when the rear edge of the preceding sheet reaches the nip portion 95 and a sheet interval time t2. That is, the switching time t for performing the bite switching operation can be prolonged more than the sheet interval time t2 by the time t1 from when the rear end of the pressure range P including the front edge of the preceding sheet passes through the nip portion 95 until when the rear edge of the preceding sheet reaches the nip portion 95. Then, it is possible to complete the switching operation until the front edge of the succeeding sheet S2 enters the nip portion 95 by prolonging the switching time t as described above.

It is noted that although the switching time t is constant regardless of the types of sheets because it depends on performance of the motor, it is desirable to shorten the switching time t as much as possible. The mode of switching the amounts of bite in a range of the rear edge of the preceding sheet and the sheet interval to correct a curl on the front edge part of the sheet as described above will be referred to as the front edge pressing mode (first mode). In other words, the pressure range P1 is set from the front edge of the sheet to an intermediate portion of the sheet and switching of the amounts of bite is started when the rear end of the pressure range P passes through the nip portion 95 in the front edge pressing mode.

Figure 6B:
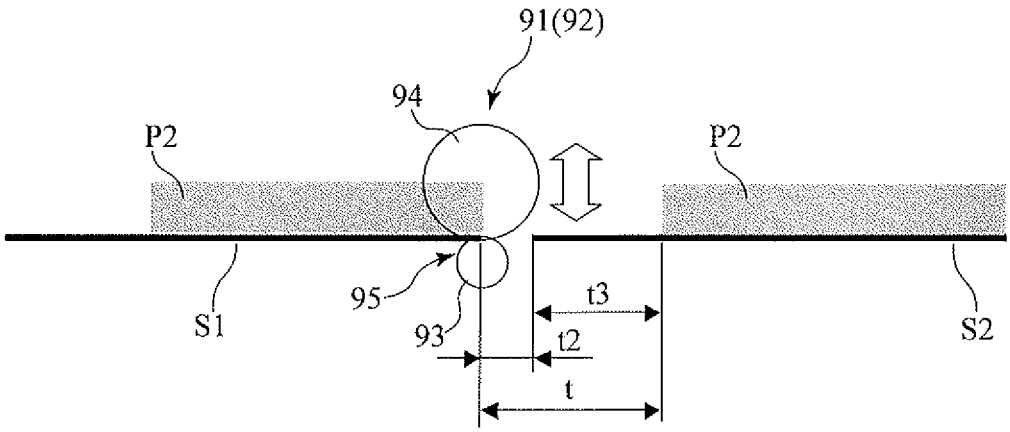
FIG. 6B is a diagram explaining a curl correcting operation in a rear edge pressurizing mode of the curl correcting portion.

By the way, the front and rear edges of the sheet are changed from those of the sheet that has been just fixed in the case of the sheet reversely discharged after the fixation or the sheet discharged after going through the process of forming an image on the back, so that the rear edge portions of preceding sheet and the succeeding sheet are curled when they reach the nip portion 95 in the reversed state. Therefore, as shown in FIG. 6B, the CPU 100 controls so as to start the operation of moving the elastic roller 94 in the direction of the arrow until the front edge portion of the succeeding sheet S2 reaches the nip portion 95 after pressing the pressure range P2 including the rear edge of the preceding sheet S1.

With this arrangement, the switching time t for performing the bite switching operation can be a total time of the sheet interval time t2 and a time 3 from when the front edge of the succeeding sheet S2 reaches the nip portion 95 till when the front of the pressure range P2 reaches the nip portion 95. That is, the switching time t for performing the bite switching operation can be prolonged more than the sheet interval time t2 by the time t3 from when the front edge of the succeeding sheet S2 reaches the nip portion 95 till when the front of the pressure range p2 reaches the nip portion 95.

It is possible to complete the switching operation until when the front of the pressure range P2 of the succeeding sheet S2 enters the nip portion 95 by prolonging the switching time t as described above. It is noted that the mode of switching the amounts of bite in the sheet interval and in the front edge portion of the succeeding sheet to correct a curl on the rear edge part of the sheet as described above will be referred to as a rear edge pressing mode (second mode) hereinafter. In other words, the pressure range P2 is set from the intermediate portion to the rear edge of the sheet and switching of the amounts of bite is started when the rear edge of the preceding sheet P1 passes through the nip portion 95 in the rear edge pressing mode.

Figure 7:
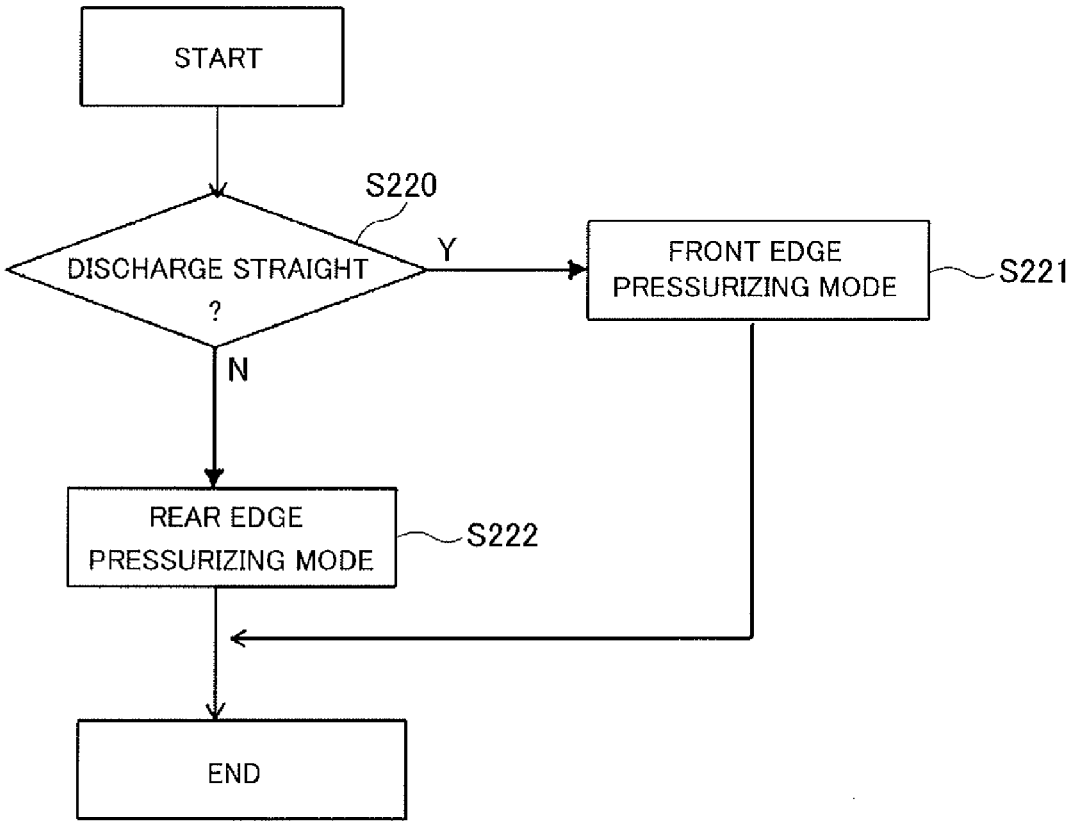
FIG. 7 is a flowchart illustrating an operation for switching the pressing modes of the curl correcting portion.

FIG. 7 is a flowchart illustrating an operation for switching the pressing modes in changing the amount of bite between the preceding sheet and the following succeeding sheet. As shown in FIG. 7, the CPU 100 judges whether or not discharge mode information input through the input portion 101 is straight discharge in Step S220. When the discharge mode information is straight discharge, i.e., Yes in Step S220, the curl correction in the front edge pressing mode shown in FIG. 6A is carried out. When the discharge mode information is not straight discharge, i.e., No in Step S220, the curl correction in the rear edge pressing mode as shown in FIG. 6B is carried out. That is, the CPU 100 is capable of selectively executing the front edge pressing mode when the preceding sheet 51 is conveyed to the pair of curl correcting rollers (curl correcting unit) through the discharge conveying path 51, and the rear edge pressing mode when the preceding sheet 51 is conveyed to the pair of curl correcting rollers (curl correcting unit) through the reverse conveying path 56.

As described above, when the types of the preceding sheet and the succeeding sheet are different, the curl correcting amount is changed to a curl correcting amount corresponding to the type of the succeeding sheet in the present embodiment. Then, when the sheet is a sheet whose downstream part in the sheet conveying direction is curled, the present embodiment is arranged so that the change of the curl correcting amount is finished from when the downstream part in the sheet conveying direction of the preceding sheet passes through the curl correcting unit until when the succeeding sheet reaches the curl correcting unit. Still further, when the sheet is a sheet whose upstream side in the sheet conveying direction is curled, the present embodiment is arranged so that the change of the curl correcting amount of the curl correcting unit is finished from when the preceding sheet passes through the curl correcting unit until when the upstream part in the sheet conveying direction of the succeeding sheet reaches the curl correcting unit.

That is, when the types of the preceding sheet and the succeeding sheet are difference, the timing of starting to change the curl correcting amount is changed corresponding to the curled part of the sheet in the present embodiment. With this arrangement, it is possible to correct the curl with the amounts of bite appropriate for the sheet per each sheet even if the sheet interval is reduced and as a result, it is possible to correct the curl securely to the different types of sheets.

Still further, it is possible to correct the curl of the range always including the front edge side right after the fixation by changing the switching timing by the path information, so that it is possible to correct the curl to be corrected steadily and efficiently. As a result, it is possible to steadily and efficiently remove the curl of the sheet even in the high performance image forming apparatus whose productivity is high and which can perform the consolidated mode. It is noted that the two curl correcting portions, i.e., the plurality of curl correcting portions, have been disposed in the curl correcting unit 3A in the present embodiment, the curl correcting portion may be one or may be three or more to more securely correct the curl.

While the embodiment of the invention has been explained above, the invention is not limited to the embodiment described above. Still further, the effects described in the embodiment of the invention are merely the most suitable effects brought about by the invention and the effects of the invention are not limited by those described in the embodiment of the invention.

Aspects of the present invention can also be realized by a computer (such as a CPU or MPU) of a system or apparatus that reads out and executes a program recorded on a memory device to perform the functions of the above-described embodiment, and by a method, the steps of which are performed by a computer of a system or apparatus by, for example, reading out and executing a program recorded on a memory device to perform the functions of the above-described embodiment. For this purpose, the program is provided to the computer for example via a network or from a recording medium of various types serving as the memory device, e.g., computer-readable medium. In an example, a computer-readable storage medium may store a program that causes a sheet storage apparatus to perform a method described herein.

In another example, a central processing unit (CPU) may be configured to control at least one unit utilized in a method or apparatus described herein.

While the present invention has been described with reference to exemplary embodiment, it is to be understood that the invention is not limited to the disclosed exemplary embodiment. The scope of the following claims is to be accorded the broadest interpretation so as to encompass all such modifications and equivalent structures and functions.

This application claims the benefit of Japanese Patent Application No. 2011-265734 filed on Dec. 5, 2011 which is hereby incorporated by reference herein in its entirety.

What is claimed is:

1. An image forming apparatus comprising:

an image forming unit configured to form a toner image on a sheet;

a fixing unit configured to fix the toner image on the sheet;

a curl correcting unit configured to correct a curl of the sheet that has passed through the fixing unit and to vary a curl correcting amount for correcting the curl of the sheet;

a control unit configured to control the curl correcting amount by the curl correcting unit to start changing the curl correcting amount from a first curl correcting amount for correcting a curl of a preceding sheet to a second curl correcting amount for correcting a curl of a succeeding sheet that follows the preceding sheet before an upstream end in the sheet conveying direction of the preceding sheet passes through the curl correcting unit, to finish changing the curl correcting amount before the succeeding sheet reaches the curl correcting unit, and to set the curl correcting amount a the second curl correcting amount when a downstream end in the sheet conveying direction of the succeeding sheet passes through the curl correcting unit.

2. The image forming apparatus according to claim 1, further comprising a reverse conveying path configured to guide the sheet from the fixing unit by reversing the downstream end in the sheet conveying direction and the upstream end in the sheet conveying direction of the sheet such that the downstream end in the sheet conveying direction at the fixing unit is changed to the upstream end in the sheet conveying direction of the sheet at the curl correcting unit;

wherein the control unit controls the curl correcting unit to start changing the curl correcting amount after an upstream end in the sheet conveying direction of the preceding sheet passes through the curl correcting unit, to finish changing the curl correcting amount after a downstream end in the sheet conveying direction reaches the curl correcting unit and before an upstream end in the sheet conveying direction of the succeeding sheet reaches the curl correcting unit and to keep the curl correcting amount at the second curl correcting amount until at least the upstream end in the sheet conveying direction of the succeeding sheet passed through the curl correcting unit in a case when the preceding sheet and the succeeding sheet are both guided in the curl correcting portion through the reverse conveying path.

3. The image forming apparatus according to claim 1, wherein the curl correcting unit comprises:

a pair of curl correcting rollers composed of rollers having different hardness and forming a curved nip portion by press-contacting with each other; and a curved amount modifying portion configured to modify a curved amount of the curved nip portion by changing press-contact pressure of the pair of curl correcting rollers;

wherein the curl correcting unit corrects the curl of the sheet by passing the sheet through the curved nip portion of the pair of curl correcting rollers, and wherein the control unit controls the curved amount modifying portion to modify the curved amount of the curved nip portion corresponding to a type of a sheet.

4. The image forming apparatus according to claim 2, wherein the curl correcting unit comprises:

a pair of curl correcting rollers composed of rollers having different hardness and forming a curved nip portion by press-contacting with each other; and a curved amount modifying portion configured to modify a curved amount of the curved nip portion by changing press-contact pressure of the pair of curl correcting rollers;

wherein the curl correcting unit corrects the curl of the sheet by passing the sheet through the curved nip portion of the pair of curl correcting rollers, and wherein the control unit controls the curved amount modifying portion to modify the curved amount of the curved nip portion corresponding to a type of a sheet.

5. The image forming apparatus according to claim 3, wherein the curl correcting unit includes first and second curl correcting portions disposed along the sheet conveying direction and each having the pair of curl correcting rollers forming the curved nip portion, and wherein the pair of curl correcting rollers of the second curl correcting portion is configured to curve in a different direction from a curving direction of the pair of curl correcting rollers of the first curl correcting portion.

6. The image forming apparatus according to claim 1, further comprising an input portion configured to input types of sheets;

wherein the control unit controls the curl correcting unit to change the curl correcting amount from the curl correcting amount corresponding to a type of a preceding sheet to the curl correcting amount corresponding to a type of a succeeding sheet when the control unit judges that the types of the preceding sheet and of the succeeding sheet are different based on sheet information input through the input portion.

7. An image forming apparatus comprising:

an image forming unit configured to form a toner image on a sheet;

a fixing unit configured to fix the toner image on the sheet;

a curl correcting unit configured to correct a curl of the sheet that has passed through the fixing unit and to vary a curl correcting amount for correcting the curl of the sheet; and a control unit configured to control the curl correcting amount by the curl correcting unit to start changing the curl correcting amount from a first curl correcting amount for correcting a curl of a preceding sheet to a second curl correcting amount for correcting a curl of a succeeding sheet that follows the preceding sheet after an upstream end in the sheet conveying direction of the preceding sheet passes through the curl correcting unit, to finish changing the curl correcting amount of the curl after a downstream end in the sheet conveying direction of the succeeding sheet reaches the curl correcting unit and before an upstream end in the sheet conveying direction of the succeeding sheet reaches the curl correcting unit, and to keep the curl correcting amount at the second curl correcting amount until at least the upstream end in the sheet conveying direction of the succeeding sheet passing through the curl correcting unit.

8. The image forming apparatus according to claim 7, wherein the curl correcting unit comprises:

a pair of curl correcting rollers composed of rollers having different hardness and forming a curved nip portion by press-contacting with each other; and a curved amount modifying portion configured to modify a curved amount of the curved nip portion by changing press-contact pressure of the pair of curl correcting rollers;

wherein the curl correcting unit corrects the curl of the sheet by passing the sheet through the curved nip portion of the pair of curl correcting rollers, and wherein the control unit controls the curved amount modifying portion to modify the curved amount of the curved nip portion corresponding to a type of a sheet.

9. The image forming apparatus according to claim 8, wherein the curl correcting unit includes first and second curl correcting portions disposed along the sheet conveying direction and each having the pair of curl correcting rollers forming the curved nip portion, and wherein the pair of curl correcting rollers of the second curl correcting portion is configured to curve in a different direction from a curving direction of the pair of curl correcting rollers of the first curl correcting portion.

10. The image forming apparatus according to claim 7, further comprising an input portion configured to input types of sheets;

wherein the control unit controls the curl correcting unit so as to change the curl correcting amount from the curl correcting amount corresponding to a type of a preceding sheet to the curl correcting amount corresponding to a type of a succeeding sheet when the control unit judges that the types of the preceding sheet and of the succeeding sheet are different from sheet information input through the input portion.

11. An image forming apparatus, comprising:

an image forming unit configured to form a toner image on a sheet;

a fixing unit configured to fix the toner image on the sheet;

a sheet processing unit configured to process the sheet on which the toner image has been fixed by the fixing unit;

a pair of curl correcting rollers disposed along a sheet conveying path between the fixing unit and the sheet processing unit and composed of an elastic roller and a metallic roller whose hardness is higher than hardness of the elastic roller and which forms a nip by press-contacting the elastic roller;

a control motor configured to change an amount of bite of the metallic roller into the elastic roller by changing relative position of the elastic roller and the metallic roller;

a conveying path configured to guide the sheet from the fixing unit to the curl correcting rollers while keeping a downstream end in a sheet conveying direction of the sheet at the fixing unit as the downstream end in the sheet conveying direction at the pair of curl correcting rollers;

a reverse conveying path configured to guide the sheet from the fixing unit by reversing the downstream end in the sheet conveying direction and an upstream end in the sheet conveying direction of the sheet such that the downstream end in the sheet conveying direction at the fixing unit is reversed to the upstream end in the sheet conveying direction of the sheet at the pair of curl correcting rollers; and a control unit configured to control the amount of bite by controlling the control motor corresponding to a type of the sheet to be conveyed and of executing a first mode when the sheet is conveyed to the pair of curl correcting rollers through the conveying path and a second mode when the sheet is conveyed to the pair of curl correcting rollers through the reverse conveying path, the control starting to switch the amount of bite in the middle of a preceding sheet passing through the nip, finishing to switch the amount of bite before a succeeding sheet that follows the preceding sheet reaches the nip, and setting the amount of bite at a changed amount of bite when the succeeding sheet reaches the nip in the first mode, and starting to switch the amount of bite in response to the rear edge of the preceding sheet passing through the nip in the second mode.

* * * * *